US011883875B2

(12) United States Patent
Takahashi et al.

(10) Patent No.: US 11,883,875 B2
(45) Date of Patent: Jan. 30, 2024

(54) FORGING DEVICE AND METHOD FOR MANUFACTURING FORGED PRODUCT

(71) Applicant: Proterial, Ltd., Tokyo (JP)

(72) Inventors: Shoichi Takahashi, Tokyo (JP); Takanori Matsui, Tokyo (JP); Etsuo Fujita, Tokyo (JP); Takeshi Fukuyama, Tokyo (JP); Shogo Suzuki, Tokyo (JP)

(73) Assignee: Proterial, Ltd.

( * ) Notice: Subject to any disclaimer, the term of this patent is extended or adjusted under 35 U.S.C. 154(b) by 137 days.

(21) Appl. No.: 17/605,872

(22) PCT Filed: Apr. 2, 2020

(86) PCT No.: PCT/JP2020/015155
§ 371 (c)(1),
(2) Date: Oct. 22, 2021

(87) PCT Pub. No.: WO2020/217916
PCT Pub. Date: Oct. 29, 2020

(65) Prior Publication Data

US 2022/0219225 A1 Jul. 14, 2022

(30) Foreign Application Priority Data

Apr. 26, 2019 (JP) ..... 2019-086062

(51) Int. Cl.
*B21J 1/06* (2006.01)
*B21J 5/02* (2006.01)
(Continued)

(52) U.S. Cl.
CPC ..... *B21J 1/06* (2013.01); *B21J 5/025* (2013.01); *B21J 13/03* (2013.01); *B21J 13/04* (2013.01);
(Continued)

(58) Field of Classification Search
CPC ..... B21J 1/06; B21J 5/02; B21J 5/025; B21J 17/00; B21J 17/02; B21J 19/02
See application file for complete search history.

(56) References Cited

U.S. PATENT DOCUMENTS 3,584,487 A * 6/1971 Carlson ..... B21K 29/00 72/38
3,698,219 A * 10/1972 Moore ..... B21K 29/00 72/38

FOREIGN PATENT DOCUMENTS

CN 2625076 Y 7/2004
CN 106391979 A 2/2017
(Continued)

OTHER PUBLICATIONS

Extended European Search Report for Application No. 20794918.1 dated May 19, 2022. 8 pgs.
Indian Office Action for Application No. 202117046291 dated Mar. 30, 2022, pp. 1-8.
International Search Report for PCT/JP2020/015155 dated Jun. 30, 2020. 3 pgs.
(Continued)

*Primary Examiner* — Katrina M Stransky
*Assistant Examiner* — Jared O Brown
(74) *Attorney, Agent, or Firm* — Lerner David LLP

(57) ABSTRACT

A forging apparatus and a forged product manufacturing method aim to prevent decrease in the temperature of a forging space and the temperature of a forging material, efficiently maintain the uniformity of the temperatures of upper and lower dies, and improve forging efficiency. In the forging apparatus and the forged product manufacturing method according to the present invention, the upper and lower dies are heated by a heating mechanism in a housing in which a charging port of an integrally formed housing body is closed by a door, the upper and lower dies are moved relatively in a facing direction of the upper and lower dies, the heating mechanism is moved relatively in the facing direction with respect to at least one of the relatively moving upper and lower dies, and whereby the forging material is
(Continued)

forged between the upper and lower dies. Furthermore, the forged product manufacturing method is used to manufacture a forged product from the forging material.

10 Claims, 5 Drawing Sheets

(51) Int. Cl.

| | |
|---|---|
| ***B21J 13/03*** | (2006.01) |
| ***B21J 13/04*** | (2006.01) |
| ***B21J 17/00*** | (2006.01) |
| ***B21K 1/28*** | (2006.01) |
| ***B21K 29/00*** | (2006.01) |

(52) U.S. Cl.
CPC ..... *B21J 17/00* (2013.01); *B21K 1/28* (2013.01); *B21K 29/00* (2013.01)

(56) References Cited

FOREIGN PATENT DOCUMENTS

| | | | |
|---|---|---|---|
| DE | 2751222 | A1 | 5/1979 |
| GB | 1334641 | A | 10/1973 |
| JP | S59225840 | A | 12/1984 |
| JP | S59225841 | A | 12/1984 |
| JP | S62207528 | A | 9/1987 |
| JP | H01165197 | U | 11/1989 |
| JP | H01278932 | A | 11/1989 |
| JP | H03180237 | A | 8/1991 |
| JP | 2015193045 | A | 11/2015 |
| JP | 2019034326 | A | 3/2019 |

OTHER PUBLICATIONS

Office Action for Japanese Application No. 2020-544554 dated Jan. 5, 2021. 5 pgs.

* cited by examiner

FORGING DEVICE AND METHOD FOR MANUFACTURING FORGED PRODUCT

CROSS-REFERENCE TO RELATED APPLICATIONS

The present application is a national phase entry under 35 U.S.C. § 371 of International Application No. PCT/JP2020/015155 filed Apr. 2, 2020, published in Japanese, which claims priority from Japanese Patent Application No. 2019-086062 filed Apr. 26, 2019, all of which are hereby incorporated by reference herein.

TECHNICAL FIELD

The present invention relates to a forging apparatus for forging a forging material between an upper die and a lower die that are heated using a heating mechanism. The present invention also relates to a method for manufacturing a forged product from the forging material forged between the heated upper die and the heated lower die.

BACKGROUND ART

Nickle-based (Ni-based) alloys such as Ni-based heat resistant superalloys, Ti (titanium)-based alloys, and the like, are used for turbine disks, turbine blades, and the like, that are applied to gas turbines, steam turbines, aircraft engines, and the like. However, since the Ni-based alloys such as Ni-based heat resistant superalloys, Ti-based alloys, and the like are materials with poor workability, hot forging such as isothermal forging and hot-die forging is adopted to plastically work these materials. Various forging apparatuses and forging methods have been proposed as hot forging techniques.

Examples of hot forging techniques include a forging apparatus that includes: an upper die and a lower die facing each other; a heating mechanism that includes an upper heating portion and a lower heating portion divided in a facing direction in which the upper die and the lower die face each other and is disposed around the upper die and the lower die; and an upper outer frame and a lower outer frame that are configured in such a manner that the upper heating portion and the lower heating portion are attached thereto, respectively, and are divided in the facing direction of the upper die and the lower die, wherein the upper die and the lower die are configured to be movable between an open condition in which the upper die and the lower die are separated in the facing direction and a closed condition in which the upper die and the lower die are in abutment with each other in the facing direction so as to be able to forge a forging material, and the upper and lower heating portions are configured to be switchable, together with the upper and lower outer frame respectively, between the open condition in which the upper heating portion and the lower heating portion are separated in the facing direction and the closed condition in which the upper heating portion and the lower heating portion are in abutment with each other in the facing direction (see Patent Document 1).

REFERENCE DOCUMENT LIST

Patent Document

Patent Document 1: JP 2015-193045 A

SUMMARY OF THE INVENTION

Problem to be Solved by the Invention

For example, in a case in which the forging material is made of a Ni-based alloy, Ti-based alloy, or the like, it is preferred that the forging material be subjected to hot forging in a high temperature atmosphere of approximately 800° C. to approximately 1200° C. in order to produce adequate quality of a forged product manufactured by hot forging the forging material. Therefore, the internal temperature of the forging apparatus, that is, the temperature of a forging space, is preferably maintained at a high temperature, and the temperature of the forging material to be subjected to hot forging is preferably maintained appropriately under such an atmosphere. It is also desired that the temperatures of the upper and lower dies be maintained uniform.

However, in the example of the hot forging technique, when charging the forging material into the forging apparatus, that is, into the forging space, the upper die and the lower die are in the open condition, and the upper and lower outer frames and the upper and lower heating portions of the heating mechanism are in the open condition in which the upper and lower outer frames are separated in the facing direction. Since the entire forging space is exposed to the outside air in the open condition of the upper and lower outer frames, the temperature of the forging space and the temperature of the forging material may decrease, making the temperatures of the upper and lower dies not uniform.

Also, since the upper and lower dies, too, are exposed to the outside air in the open condition of the upper and lower outer frames, the upper and lower dies, which are typically made of metal, easily oxidize. Furthermore, when the temperature of the forging space drops, a heating operation needs to be carried out to increase the temperature of the forging space, which is especially time consuming. Frequently executing such heating operation causes the temperatures of the upper and lower dies to fluctuate frequently. The oxidization of the upper and lower dies and frequent fluctuations in the temperatures of the upper and lower dies cause the upper and lower dies to deteriorate easily, shortening a replacement cycle of the upper and lower dies. As a result, the forging efficiency may drop.

In view of the foregoing circumstances, it is desired that the forging apparatus and the forged product manufacturing method prevent the decrease in the temperature of the forging space and the temperature of the forging material, efficiently maintain the uniformity of temperatures of the upper and lower dies, and improve the forging efficiency. Consequently, it is desired that the forging apparatus and the forged product manufacturing method efficiently manufacture a forged product of satisfactory quality.

Means for Solving the Problem

In order to solve the foregoing problems, a forging apparatus according to one aspect includes: an upper die; a lower die facing the upper die; a heating mechanism configured to be able to heat the upper and lower dies; and a housing in which the upper die, the lower die, and the heating mechanism are arranged, the upper and lower dies being configured to be movable relative to each other in a facing direction of the upper and lower dies so as to be able to forge a forging material between the upper and lower dies, wherein the housing is integrally formed so as to surround the upper die, the lower die, and the heating mechanism, and includes a housing body having a charging port opened so as to allow the forging material to pass therethrough, and a door configured to be able to open and close the charging port of the housing body, wherein the heating mechanism is disposed so as to partially or entirely face outer peripheral side surfaces of the upper and lower dies, and the heating mechanism is configured to move in the facing direction relatively with respect to at least one of the upper and lower dies moving relatively.

In order to solve the foregoing problems, a forged product manufacturing method according to one aspect is a method for manufacturing a forged product from a forging material by forging between an upper die and a lower die facing each other inside a housing, the method including the steps of: charging the forging material into the housing having an integrally formed housing body through a charging port of the housing body; and forging the forging material between the upper and lower dies by heating the upper and lower dies with a heating mechanism under a condition in which the charging port of the housing body is closed by a door, the heating mechanism being disposed inside the housing so as to partially or entirely face outer peripheral side surfaces of the upper and lower dies, moving the upper and lower dies relatively in a facing direction of the upper and lower dies, and moving the heating mechanism in the facing direction relatively with respect to at least one of the upper and lower dies moving relatively.

Effects of the Invention

In the forging apparatus and the forged product manufacturing method according to the aspect, a decrease in temperatures of a forging space and the forging material can be prevented, the uniformity of the temperatures of the upper and lower dies can be efficiently maintained, and forging efficiency can be improved. Consequently, the forging apparatus and the forged product manufacturing method according to the aspect can efficiently manufacture a forged product of satisfactory quality.

MODE FOR CARRYING OUT THE INVENTION

A forging apparatus and a forged product manufacturing method according to an embodiment are described hereinafter. Note that the forging apparatus and the manufacturing method according to the present embodiment execute hot forging. The hot forging includes isothermal forging that maintains the temperatures of upper and lower dies used in forging substantially equal to the temperature of a forging material, and hot-die forging that brings the temperatures of the upper and lower dies close to the temperature of the forging material.

Outline of Forging Apparatus

First, an outline of a forging apparatus 1 according to the present embodiment is described with reference to FIGS. 1 to 7. The forging apparatus 1 includes an upper die 2 and a lower die 3 used in forging. These upper die 2 and lower die 3 face each other. Hereinafter, a direction in which the upper die 2 and lower die 3 face each other is referred to as "die facing direction," as necessary. In FIGS. 1 to 6, the die facing direction is indicated by an arrow F. Furthermore, in FIGS. 2 and 3, a forging material M is disposed between the upper die 2 and lower die 3 in a die open condition in which the upper die 2 and lower die 3 are separated from each other in the die facing direction prior to forging. In FIG. 4, a forged product P is disposed between the upper die 2 and lower die 3 in a die closed condition in which the upper die 2 and lower die 3 are in contact with each other in the die facing direction after forging.

Figure 1:
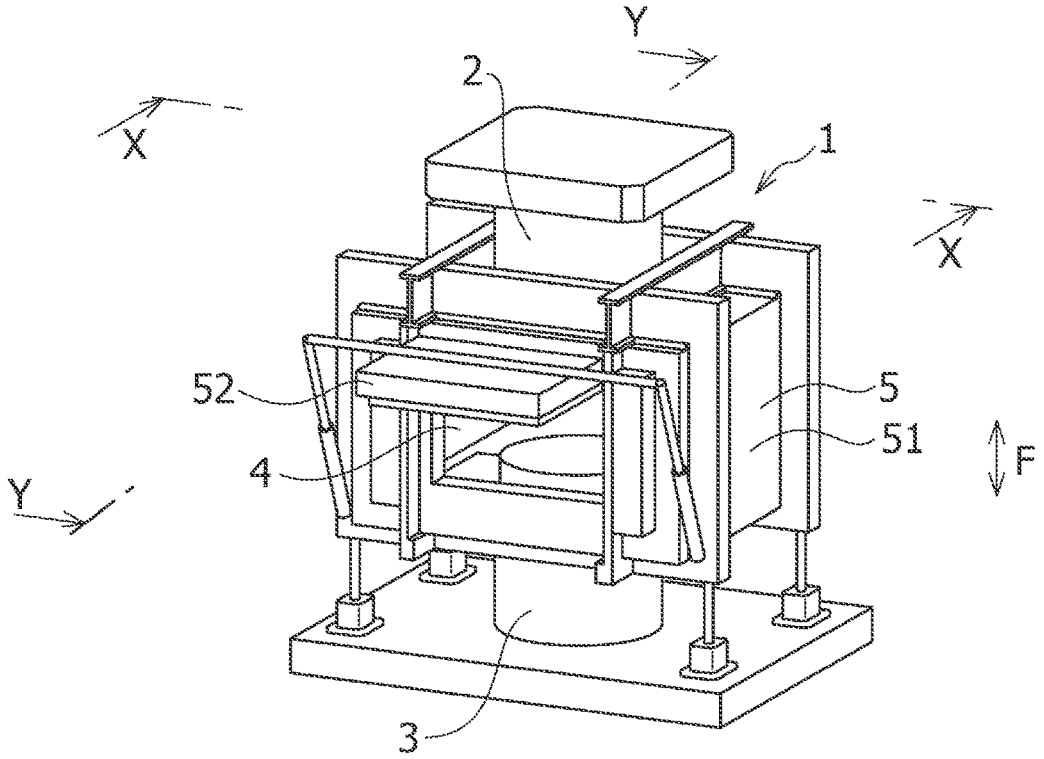
FIG. 1 is a perspective view schematically showing a forging apparatus according to an embodiment, with an upper die, a lower die and a door open.

As shown in FIGS. 1 to 4, the forging apparatus 1 has a heating mechanism 4. The heating mechanism 4 is configured to be able to heat the upper die 2 and lower die 3. The forging apparatus 1 also has a housing 5. The upper die 2 and lower die 3 and the heating mechanism 4 are arranged inside the housing 5. In this forging apparatus 1, the upper die 2 and lower die 3 are configured to be relatively movable in the die facing direction so as to be able to forge the forging material M between the upper die 2 and lower die 3. The heating mechanism 4 shown in FIG. 1 is merely an example; the heating mechanism 4 is not limited thereto. The heating mechanism may be disposed in a cylindrical shape so as to surround cylindrical dies.

Figure 3:
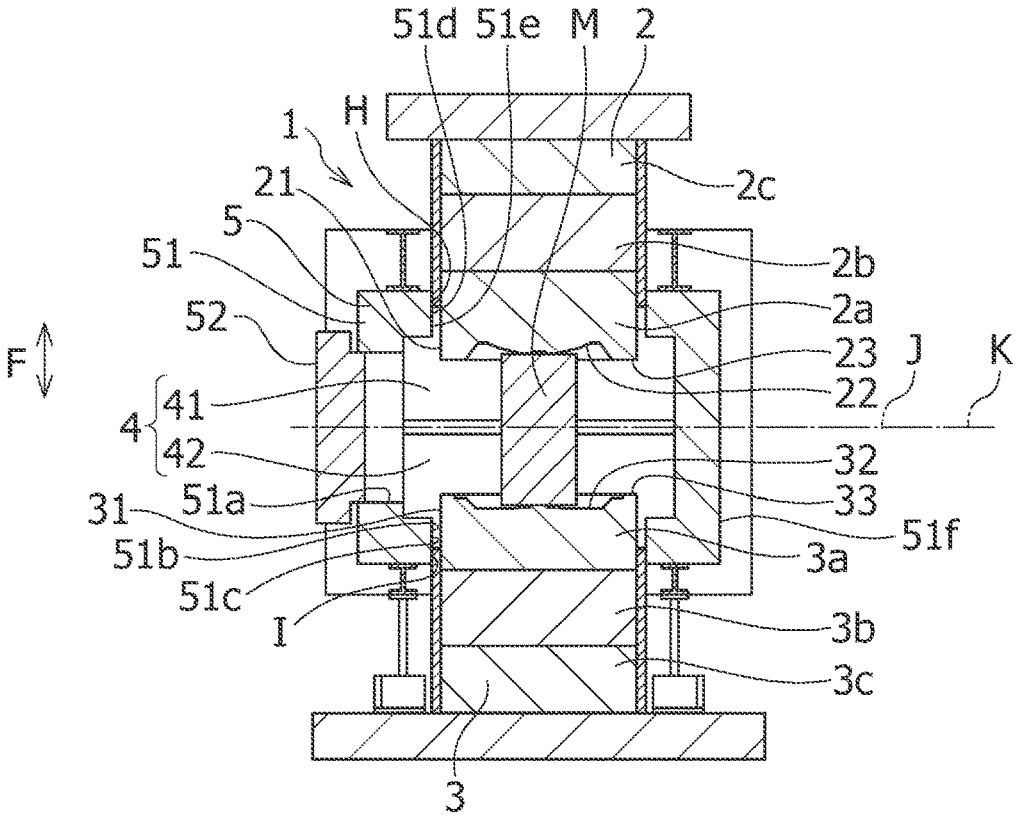
FIG. 3 is a cross-sectional diagram schematically showing the forging apparatus according to the embodiment, with the upper and lower dies open and the door closed, the diagram omitting the illustration of the gas supply mechanism and taken along line Y-Y of FIG. 1.
Figure 4:
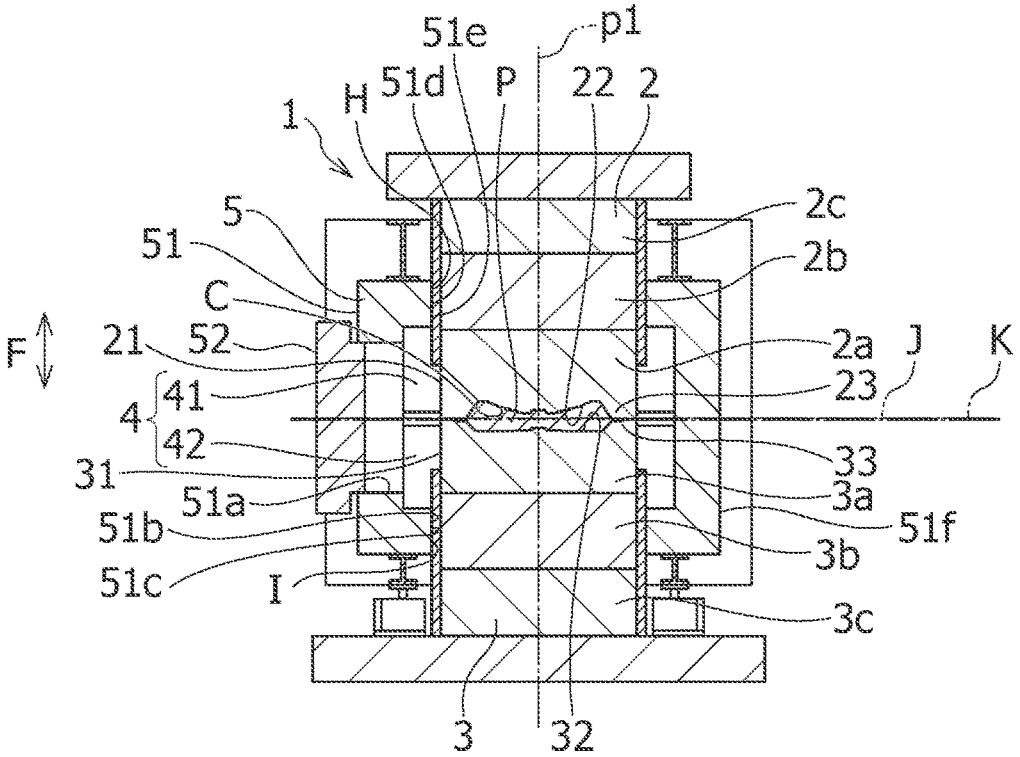
FIG. 4 is a cross-sectional diagram schematically showing the forging apparatus according to the embodiment, with the upper and lower dies and the door closed, the diagram omitting the illustration of the gas supply mechanism and taken along line Y-Y of FIG. 1.

As shown in FIGS. 1, 3 and 4, the housing 5 includes a housing body 51 and a door 52. The housing body 51 is formed integrally so as to surround the upper die 2 and lower die 3 and the heating mechanism 4. The housing body 51 also includes a charging port 51*a* that is opened to enable the passage of the forging material M. The door 52 is configured to be able to open and close the charging port 51*a* of the housing body 51.

Figure 2:
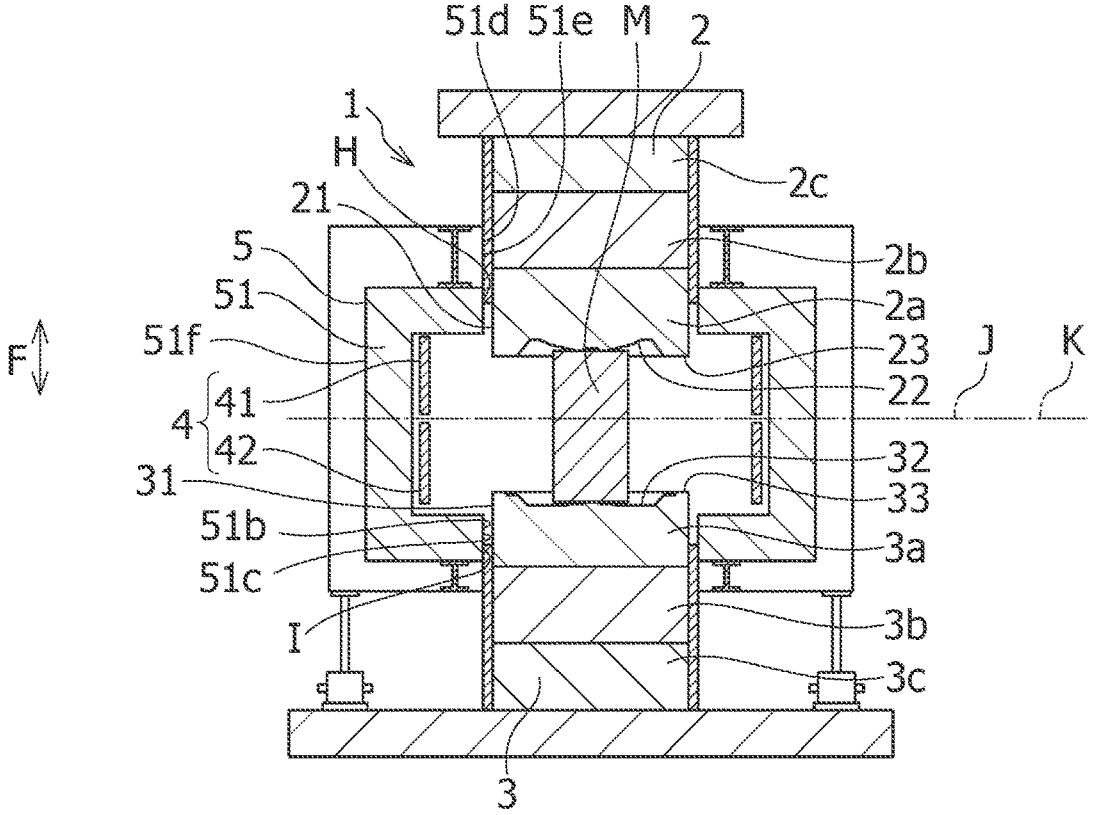
FIG. 2 is a cross-sectional diagram schematically showing the forging apparatus according to the embodiment, with the upper and lower dies open, the diagram omitting the illustration of a gas supply mechanism and taken along line X-X of FIG. 1.

As shown in FIGS. 2 to 4, the heating mechanism 4 is disposed so as to partially or entirely face outer peripheral side surfaces 21 and 31 of the respective upper die 2 and lower die 3. The heating mechanism 4 is also configured to move relatively in the facing direction with respect to at least one of the relatively moving upper die 2 and lower die 3.

Also, the outline of the forging apparatus 1 is preferably as follows. As shown in FIGS. 2 to 4, the heating mechanism 4 is configured to move so as to maintain a condition in which a reference position J of the heating mechanism 4 in the die facing direction and a center position K between the upper die 2 and lower die 3 in the die facing direction substantially match each other in the die facing direction. The heating mechanism 4 also includes an upper heating portion 41 and a lower heating portion 42 located on the lower die 3 side of the upper heating portion 41 in the die facing direction. The upper and lower heating portions 41 and 42 are configured to be able to adjust heating temperatures of the upper and lower heating portions 41 and 42 independently of each other.

Figure 5:
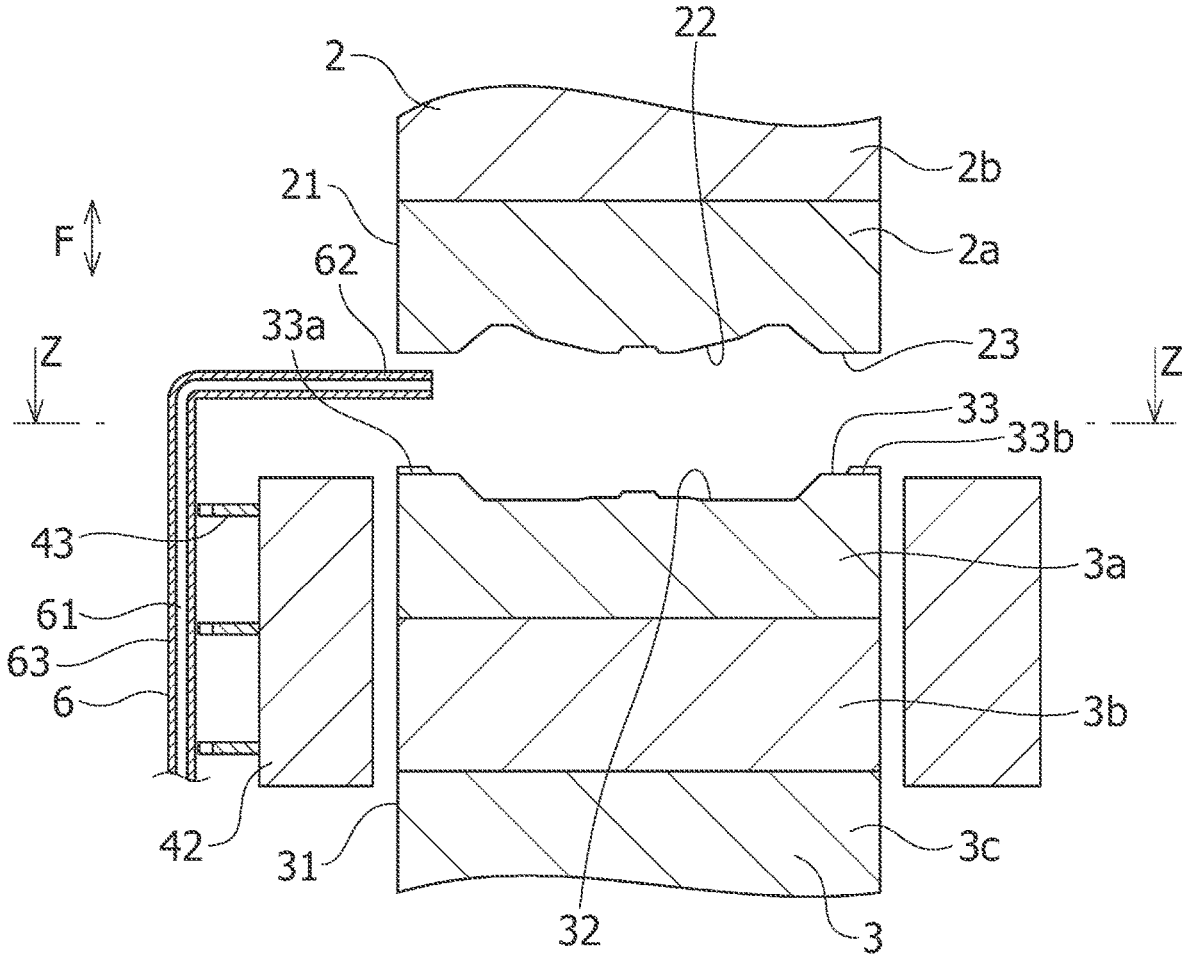
FIG. 5 is a cross-sectional diagram schematically showing the upper and lower dies and the gas supply mechanism of the forging apparatus according to the embodiment, with the upper and lower dies open and the gas supply mechanism not installed, the diagram taken along line X-X of FIG. 1.
Figure 6:
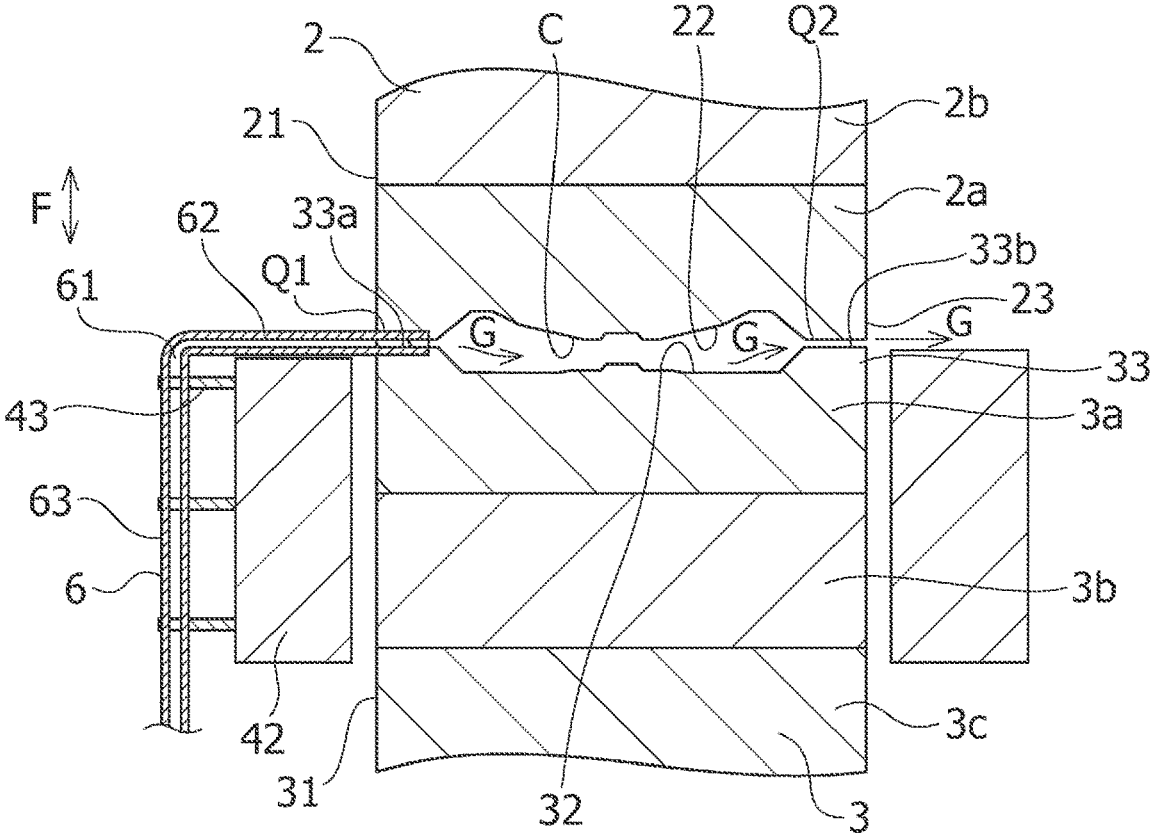
FIG. 6 is a cross-sectional diagram schematically showing the upper and lower dies and the gas supply mechanism of the forging apparatus according to the embodiment, with the upper and lower dies open and the gas supply mechanism installed, the diagram taken along line X-X of FIG. 1.
Figure 7:
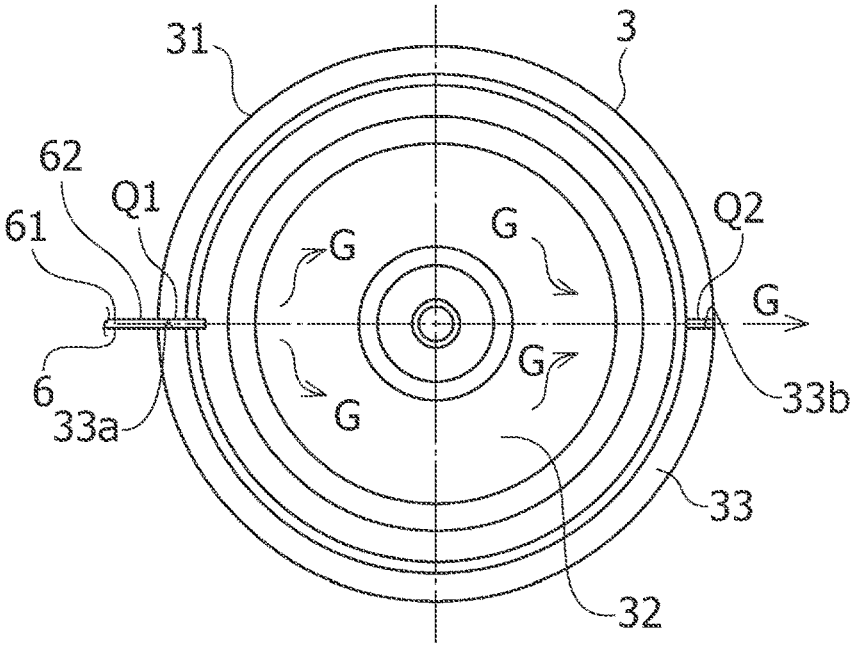
FIG. 7 is a cross-sectional diagram schematically showing the lower die and a supply pipe of the gas supply mechanism of the forging apparatus according to the embodiment, with the gas supply mechanism installed, the diagram taken along line Z-Z of FIG. 5.

As shown in FIGS. 5 to 7, the upper die 2 and lower die 3 include cavity portions 22 and 32 respectively that are configured to form a cavity C, a space for forging the forging material M, in the die closed condition in which the upper die 2 and lower die 3 are in contact with each other. The forging apparatus 1 includes a gas supply mechanism 6 configured to be able to supply inert gas G to the inside of the housing 5.

As shown in FIGS. 4 and 6, the gas supply mechanism 6 is preferably able to supply the inert gas G to the cavity portions 22 and 32 of the respective upper die 2 and lower die 3 in the die closed condition, that is, the cavity C in particular. However, the gas supply mechanism may also be able to supply the inert gas to the cavity portions of the upper and lower dies in the die open condition. The gas supply mechanism may also be configured to be able to supply the inert gas to the inside of the housing and the outside of the upper and lower dies.

In addition, the housing body 51 also includes a lower die passage port 51*b* that is opened to allow the lower die 3 to be inserted therethrough so as to be movable in the die facing direction. A lower gap I is formed between the lower die 3 and a rim portion 51*c* of the lower die passage port 51*b*. In particular, it is preferred that such lower gap I be formed when the die facing direction is along a vertical direction.

The housing 5 is preferably configured to be sealed except for the lower gap I, with the door 52 being closed. The size of the lower gap I is preferably set so as to allow smooth passage of the lower die 3, to allow the passage of the inert gas G from the gas supply mechanism 6, and to be able to suppress a temperature drop inside the housing 5. However, the housing can also be sealed without providing the lower gap.

Details of Forging Material and Forged Product

Referring to FIGS. 5 to 7, it is preferred that the forging material M and the forged product P be in particular as follows. The forging material M is a preformed body for obtaining a final shape of the forged product P. The shape of the forged product P is substantially rotationally symmetric with respect to an axis p1 extending along the die facing direction. For example, the forged product P is preferably used for turbine disks and the like that are applied to gas turbines, steam turbines, aircraft engines, and the like. However, the shape of the forged product and the applications of the forged product are not limited thereto.

The material used for the forging material M and the forged product P is metal. For example, such material can be nickel-based (Ni-based) alloys such as Ni-based heat resistant superalloys, Ti (titanium)-based alloys, and the like. However, the material used for the forging material and the forged product is not limited thereto.

It is preferred that a lubricant be applied to the forging material M. For example, the lubricant can be a glass lubricant containing non-alkali glass, or the like. However, the lubricant is not limited thereto.

Details of Upper Die and Lower Die

It is preferred that the upper die 2 and the lower die 3 be in particular as follows. As shown in FIGS. 2 to 4, the upper die 2 and lower die 3 each have a plurality of layers stacked in the die facing direction. FIGS. 2 to 4 show an example in which the upper die 2 has a first layer 2*a*, a second layer 2*b*, and a third layer 2*c* arranged in order, in such a manner as to separate from the lower die 3 in the die facing direction, and the lower die 3 has a first layer 3*a*, a second layer 3*b*, and a third layer 3*c* arranged in order, in such a manner as to separate from the upper die 2 in the die facing direction. However, the number of layers in each of the upper and lower dies is not limited thereto.

It is preferred that the same material be used for the upper die 2 and lower die 3. However, the upper and lower dies may employ materials different from each other.

In particular, a material of a lower end layer of the upper die 2 located closest to the lower die 3, such as the first layer 2*a* of the upper die 2 described above, is preferably metal. A material of an upper end layer of the lower die 3 located closest to the upper die 2, such as the first layer 3*a* of the lower die 3 described above, is also preferably metal. For example, such metallic material may be a Ni-based alloy such as a Ni-based heat resistant superalloy.

Moreover, for example, the metallic materials used for the upper die 2 and lower die 3, or the lower end layer of the upper die 2 and the upper end layer of the lower die 3 in particular, can be a Ni-based alloy called NIMOWAL (registered trademark). NIMOWAL is a Ni-based alloy containing Mo (molybdenum), W (tungsten), and Al (aluminum) as essential elements and having excellent heat resistance, and can further contain elements that improve oxidation resistance. In the case of the present invention, a preferred composition of each of the metallic materials used for the upper die 2 and lower die 3, or the lower end layer of the upper die 2 and the upper end layer of the lower die 3 in particular, can be of a Ni-based alloy containing, in percent by mass, W of approximately 7.0% to approximately 15.0%, Mo of approximately 2.5% to 11.0%, Al of approximately 5.0% to 7.5%, Cr (chromium) of approximately 0.5% to approximately 3.0%, Ta (tantalum) of approximately 0.5% to approximately 7.0%, S (sulfur) of approximately 0.0010% or less, approximately 0 (zero) % to approximately 0.020% in total of one or two or more selected from rare earth elements, Y (yttrium) and Mg (magnesium), and the balance of Ni and unavoidable impurities. Such Ni-based alloy can further contain, in percent by mass, approximately 0.5% or less in total of one or both selected from the elements of Zr (zirconium) and Hf (hafnium). The Ni-based alloy can further contain, in percent by mass, 3.5% or less in total of one or both selected from the elements of Ti and Nb (niobium), wherein the total of Ta, Ti and Nb contents can be approximately 1.0% to approximately 7.0%. The Ni-based alloy can also contain, in percent by mass, Co (cobalt) of approximately 15.0% or less. The Ni-based alloy can further contain, in percent by mass, one or both selected from the elements of C (carbon) of approximately 0.25% or less and B (boron) of approximately 0.05% or less. The Ni-based alloy can have an approximately 0.2% compressive strength of approximately 500 MPa or higher at a test temperature of approximately 1000° C. and a strain rate of approximately $10^{-3}$/sec. The Ni-based alloy can have an approximately 0.2% compressive strength of approximately 300 MPa or higher at a test temperature of approximately 1100° C. and a strain rate of approximately $10^{-3}$/sec.

Additionally, the material for at least one of the layers of the upper die 2 other than the lower end layer, that is, at least one of the second and third layers 2*b* and 2*c* of the upper die 2 described above, can be ceramic (refractory), a heat insulating sheet, a blanket, or the like. The material for at least one of the layers of the lower die 3 other than the upper end layer, that is, at least one of the second and third layers 3*b* and 3*c* of the lower die 3 described above, can also be ceramic (refractory), a heat insulating sheet, a blanket, or the like. The material for at least one of the layers of the upper die other than the lower end layer can be metal, e.g., a Ni-based alloy such as a Ni-based heat resistant superalloy. The material of at least one of the layers of the lower die other than the upper end layer can also be metal, e.g., a Ni-based alloy such as a Ni-based heat resistant superalloy. However, the materials used for the upper and lower dies are not limited to those described above.

Also, it is preferred that outer surfaces of the upper die 2 and lower die 3 be coated with an oxidation-resistant material. For example, from the perspective of preventing oxidation of the surfaces of the die caused by the contact between oxygen in air at high temperature and the base materials of the dies, resultant scale scattering, and deterioration of the work environment and the shapes of the dies, it is preferred that, for example, an inorganic material composed of any one or more of nitrides, oxides, and carbides be used in the oxidation-resistant coating. Such inorganic material is used for the purpose of forming a dense oxygen barrier film by means of the nitride, oxide, and/or carbide coating layer, and preventing oxidation of the base materials of the dies. The coating layer may be a single layer composed of any one of nitrides, oxides, and carbides, or a laminated structure composed of a combination of any two or more of nitrides, oxides, and carbides. It is also preferred that a mixture of any two or more of nitrides, oxides, and carbides, a ceramic coating, and the like be used as the coating layer. However, the oxidation-resistant coating is not limited thereto.

As shown in FIGS. 1 to 7, in a typical use of the forging apparatus, the upper die 2 is located above the lower die 3 in the vertical direction, and the die facing direction is along the vertical direction. However, the use of the upper and lower dies is not limited thereto. For example, in extremely exceptional uses, the upper and lower dies can face each other in a direction inclined with respect to the vertical direction, can be reversed in the vertical direction, or can face each other in a horizontal direction.

As shown in FIGS. 3 and 6, the upper die 2 includes a facing portion 23 facing the lower die 3. The cavity portion 22 of the upper die 2 is formed so as to be recessed from the facing portion 23 of the upper die 2 in the die facing direction. The lower die 3, too, includes a facing portion 33 facing the upper die 2. The cavity portion 32 of the lower die 3 is formed so as to be recessed from the facing portion 33 of the lower die 3 in the die facing direction.

The upper die 2 and lower die 3 are movable in the die facing direction between the die open condition shown in FIGS. 2, 3 and 5 and the die closed condition shown in FIGS. 4 and 6. In the die open condition, as shown in FIGS. 2, 3 and 5, a space is formed between the facing portions 23 and 33 of the upper die 2 and lower die 3 so that the forging material M prior to forging can be charged, and the forged product P can be taken out after forging. In the die closed condition, as shown in FIGS. 4 and 6, the facing portions 23 and 33 of the upper die 2 and lower die 3 abut against each other. The shape of the cavity C formed by the cavity portions 22 and 32 of the upper die 2 and lower die 3 in the die closed condition corresponds to the shape of the forged product P.

As shown in FIGS. 5 to 7, the upper die 2 and lower die 3 are provided with an inlet Q1 that is configured to allow the inert gas G to flow into the cavity C from the outside of the upper die 2 and lower die 3 in the die closed condition. An inflow groove 33*a* that is recessed so as to conform to an outer peripheral surface 61*a* of a gas supply pipe 61 of the gas supply mechanism 6 described hereinafter is preferably formed in the facing portion 33 of the lower die 3. The gas supply pipe 61 is disposed in the inflow groove 33*a*, thereby providing the inlet Q1. However, the inflow groove can be formed in at least one of the facing portions of the upper and lower dies. Specifically, the inflow groove can be formed only in the facing portion of the upper die. The inflow groove can also be formed in the facing portions of both of the upper and lower dies.

The upper die 2 and lower die 3 are provided with an outlet Q2 that is configured to allow the inert gas G to flow out from the cavity C to the outside of the upper die 2 and lower die 3 in the die closed condition. It is preferred that an outflow groove 33*b* be formed in the facing portion 33 of the lower die 3 so as to provide such an outlet Q2. However, the outflow groove may be formed only in one of the facing portions of the upper and lower dies. However, the outflow groove can be formed in at least one of the facing portions of the upper and lower dies. Specifically, the outflow groove can be formed only in the facing portion of the upper die. The outflow groove can also be formed in the facing portions of both of the upper and lower dies.

As shown in FIGS. 2 to 4, the upper die 2 and lower die 3 each have a plurality of layers stacked in the die facing direction. FIGS. 2 to 4 show, as an example, a case in which the upper die 2 has the first layer 2*a*, the second layer 2*b*, and the third layer 2*c*, arranged in order, in such a manner as to separate from the lower die 3 in the die facing direction, and the lower die 3 has the first layer 3*a*, the second layer 3*b*, and the third layer 3*c* arranged in order, in such a manner as to separate from the upper die 2 in the die facing direction. However, the number of layers in each of the upper and lower dies is not limited thereto.

Regarding the relative movement of the upper die 2 and lower die 3, referring to FIGS. 2 to 4, the upper die 2 is movable in the die facing direction, whereas the lower die 3 is fixed. However, the relative movement of the upper and lower dies is not limited thereto. For example, the upper die can be fixed and the lower die can be moved in the die facing direction. Alternatively, both the upper and lower dies can be configured to be movable in the die facing direction.

Details of Heating Mechanism

It is preferred that the heating mechanism 4 be in particular as follows. As shown in FIGS. 2 to 4, the heating mechanism 4 includes at least one heater configured to be able to heat the upper die 2 and lower die 3. Furthermore, each of the upper and lower heating portions 41 and 42 of the heating mechanism 4 may include at least one heater. For example, a heating wire such as Kanthal (registered trademark) Super or nichrome wire, or a silicon carbide-based rod-shaped resistance heating element can be used as the heater. However, examples of the heater are not limited thereto.

The heating mechanism 4, the upper and lower heating portions 41 and 42 in particular, are spaced apart from the upper die 2 and lower die 3, respectively, in a direction substantially perpendicular to the die facing direction. The reference position J of the heating mechanism 4 is set so that temperature distributions of the upper die 2 and lower die 3 can be made substantially uniform. FIGS. 2 to 4 show an example in which the reference position J of the heating mechanism 4 is located substantially in the center of the heating mechanism 4 in the die facing direction. However, the reference position of the heating mechanism may be located closer to the upper die or the lower die with respect to the substantial center of the heating mechanism in the die facing direction.

The upper heating portion 41 is located on the upper die 2 side in the die facing direction with respect to the reference position J of the heating mechanism 4. The upper heating portion 41 is disposed so as to partially or entirely face the outer peripheral side surface 21 of the upper die 2. The lower heating portion 42 is located on the lower die 3 side in the die facing direction with respect to the reference position J of the heating mechanism 4. The lower heating portion 42 is disposed so as to partially or entirely face the outer peripheral side surface 31 of the lower die 3.

However, the upper heating portion can be disposed so as to extend across the reference position of the heating mechanism. In such a case, in the die closed condition, the upper heating portion is disposed so as to partially or entirely face the outer peripheral side surfaces of the upper and lower dies, and the lower heating portion is disposed so as to partially or entirely face the outer peripheral side surface of the lower die. On the other hand, the lower heating portion can also be disposed so as to extend across the reference position of the heating mechanism. In such a case, in the die closed condition, the upper heating portion is disposed so as to partially or entirely face the outer peripheral side surface of the lower die, and the lower heating portion is disposed so as to partially or entirely face the outer peripheral side surfaces of the upper and lower dies.

The heating mechanism 4 is also fixed to the housing body 51. The heating mechanism 4 is attached to the housing body 51. The heating mechanism 4 is also disposed so as to avoid the charging port 51*a* of the housing body 51. The heating mechanism 4 is disposed on the outside in an outer peripheral direction of the housing 5 with respect to the charging port 51*a* of the housing body 51. The length of the heating mechanism 4 in the die facing direction is preferably equal to or less than the length of the charging port 51*a* in the die facing direction. The upper and lower heating portions 41 and 42 of the heating mechanism 4 are fixed to the housing body 51. The upper and lower heating portions 41 and 42 are also arranged so as to avoid the charging port 51*a* of the housing body 51.

However, the relationship between the heating mechanism and the housing is not limited thereto. The heating mechanism can also be disposed so as to overlap the door. The heating mechanism can also be disposed so as to overlap at least one of the upper and lower dies in the die facing direction. The length of the heating mechanism in the die facing direction can be made longer than the length of the charging port in the die facing direction. The heating mechanism can be configured to be movable with respect to the housing body in the die facing direction. At least one of the upper and lower heating portions can be configured to be movable with respect to the housing body in the die facing direction.

As shown in FIGS. 5 and 6, the heating mechanism 4 includes an attached portion 43 that is configured to be able to attach the gas supply pipe 61, which is described hereinafter, in a removable manner. The attached portion 43 can be provided on the lower heating portion 42. However, the attached portion can also be provided on the upper heating portion.

Details of Housing

It is preferred that the housing 5 in particular be as follows. As shown in FIGS. 2 to 4, the housing body 51 includes an upper die passage port 51*d* that is opened to allow the upper die 2 to be inserted therethrough so as to be movable in the die facing direction. An upper gap H is formed between the upper die 2 and a rim portion 51*e* of the upper die passage port 51*d*. It is particularly preferred that the upper gap H be formed when the die facing direction is along the vertical direction.

The housing 5 is preferably configured to be sealed except for the upper and lower gaps H and I, with the door 52 being closed. The size of the upper gap H is preferably set so as to enable smooth passage of the upper die 2 and to suppress a temperature drop inside the housing 5. The upper gap H is preferably smaller than the lower gap I described above. However, the upper gap can be the same in size as the lower gap. Also, the upper gap can be made larger than the lower gap. Furthermore, the upper and lower gaps H and I can be improved in airtightness in a slidable state by using a gland packing or the like. Increasing the airtightness can improve the temperature drop and temperature non-uniformity in the upper and lower dies that are caused by the outside air flowing in and out.

As shown in FIGS. 1, 3 and 4, the charging port 51*a* of the housing body 51 is disposed on an outer peripheral side portion 51*f* of the housing body 51. The charging port 51*a* is formed so as to penetrate the outer peripheral side portion 51*f* of the housing body 51. The charging port 51*a* is preferably disposed so as to conform to the space formed between the upper die 2 and lower die 3 opened in the die facing direction.

Referring to FIGS. 2 to 4, the housing 5 is configured to be movable in the die facing direction. The heating mechanism 4 fixed to the housing body 51 of the housing 5 is configured to move in synchronization with the movement of the housing 5. The upper and lower heating portions 41 and 42 fixed to the housing body 51 are configured to move in synchronization with the movement of the housing 5. However, the housing can be configured not to move essentially in the die facing direction, and at least one of the upper and lower heating portions can be configured to be movable with respect to the housing in the die facing direction.

In addition, in FIGS. 1, 3 and 4, the housing 5 includes one door 52 that is rotatably attached to the housing body 51, in which the door 52 is configured to be movable, by rotating between a closed condition in which one charging port 51*a* of the housing body 51 is closed, and an open condition in which the one charging port 51*a* of the housing body 51 is opened. However, the present invention is not limited to this configuration. For example, the housing may include two doors that are rotatably attached to the housing body, wherein the two doors are configured to be movable between the closed condition and the open condition by rotating in the form of a double-hinged door. In addition, for example, the housing may include a door that is slidably attached to the housing body, in which the door is configured to be movable between the closed condition and the open condition by sliding. Also, the housing and the housing body may be arranged in a cylindrical shape so as to surround the cylindrical dies. The housing and the housing body may have a double door structure in order to prevent as much as possible the temperatures of the dies and the forging space from dropping.

Details of Gas Supply Mechanism

It is preferred that the gas supply mechanism 6 be in particular as follows. The inert gas G supplied by the gas supply mechanism 6 is capable of reducing the oxygen concentration inside the housing 5, in particular in the cavity C between the upper die 2 and lower die 3. The inert gas G can be, for example, Ar (argon) gas. However, the inert gas is not limited thereto. The inert gas can also be, for example, N (nitrogen) gas, He (helium) gas, or the like.

As shown in FIGS. 5 and 6, the gas supply mechanism 6 includes the gas supply pipe 61 configured to allow the inert gas G to pass therethrough. The gas supply pipe 61 includes a tip portion 62 capable of discharging the inert gas G, and an attaching portion 63 configured to be removably attached to the attached portion 43 of the heating mechanism 4. The tip portion 62 is disposed along the inflow groove 33*a*. The attaching portion 63 is disposed along the die facing direction. The gas supply pipe 61 is formed in a substantially L-shape. However, the structure of the gas supply pipe is not limited thereto.

Method for Manufacturing Forged Product

Figure 8:
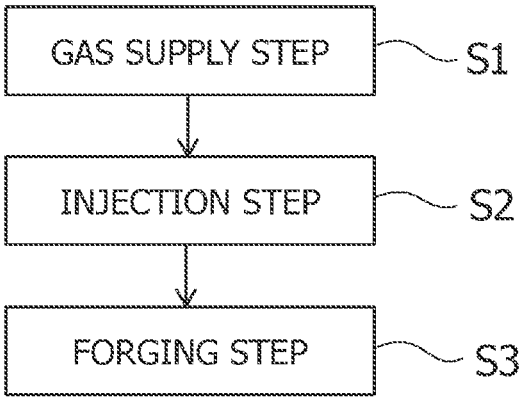
FIG. 8 is a flowchart for explaining a forged product manufacturing method according to the embodiment.

A method for manufacturing the forged product P according to the present embodiment is now described with reference to FIG. 8. In the method for manufacturing the forged product P, the upper die 2 and lower die 3 are heated by the heating mechanism 4, in which the forging material M is forged between the upper die 2 and lower die 3, and the forged product P is manufactured from the forging material M.

First, in the method for manufacturing the forged product P, the inert gas G is supplied to the inside of the housing 5 (gas supply step S1). In the gas supply step S1, the inert gas G is supplied to the cavity portions 22 and 32 of the upper die 2 and lower die 3 in the die closed condition. By supplying the inert gas G in this manner, the oxygen concentrations in the cavity portions 22 and 32 of the upper die 2 and lower die 3 can be reduced to approximately 1% or less. However, as long as the oxidation of the upper and lower dies can be prevented efficiently, the oxygen concentrations in the cavity portions of the upper and lower dies may be greater than approximately 1% by supplying the inert gas.

Also, in the gas supply step S1, it is preferred that the gas supply pipe 61 of the gas supply mechanism 6 be attached to the attached portion 43 of the heating mechanism 4 immediately before the inert gas G is supplied. Moreover, the gas supply pipe 61 is preferably removed from the attached portion 43 of the heating mechanism 4 after the completion of the gas supply step S1. However, the timing of attaching/removing the gas supply pipe is not limited thereto. The gas supply pipe can also be left installed inside the forging apparatus, or in the housing in particular.

Next, the forging material M is charged into the housing 5 having the integrally formed housing body 51, from the charging port 51*a* of the housing body 51 (charging step S2). In the charging step S2, the forging material M heated by a heating furnace or the like is charged into the housing 5. When transferring the forging material M from the heating furnace or the like to the housing 5, a jig that prevents the temperature of the forging material M from dropping is preferably used.

The forging material M is forged between the upper die 2 and lower die 3 (forging step S3). When executing the forging in this forging step S3, the upper die 2 and lower die 3 are heated by the heating mechanism 4 inside the housing 5 in the closed condition in which the charging port 51*a* of the housing body 51 is closed by the door 52, the upper die 2 and lower die 3 are moved relatively in the die facing direction, and the heating mechanism 4 is moved relatively in the die facing direction with respect to at least one of the relatively moving upper die 2 and lower die 3. The forged product P is manufactured from the forging material M that is forged in this manner. During forging, the heating mechanism 4 heats the upper die 2 and lower die 3 continuously or intermittently. However, as long as the temperatures of the upper and lower dies are maintained properly, the heating mechanism may not heat the upper and lower dies during forging.

In the forging step S3, the relative movement of the heating mechanism 4 may be carried out so as to maintain the condition in which the reference position J of the heating mechanism 4 in the die facing direction and the center position K between the upper die 2 and lower die 3 in the die facing direction match each other in the die facing direction. However, the manufacturing method is not limited thereto. The gas supply step can also be executed after the charging step and prior to the forging step. In the gas supply step, the inert gas can also be supplied to the cavity portions of the upper and lower dies in the die open condition. Furthermore, in the gas supply step, the inert gas can be supplied to the inside of the housing and the outside of the upper and lower dies.

The temperatures of the upper die 2 and lower die 3 and the temperature of the forging space during forging are preferably set according to the type of the metal used for the forging material M and the forged product P. For example, in a case in which the material used for the forging material M and the forged product P is a Ni-based alloy, a Ti-based alloy, or the like, the temperatures of the upper die 2 and lower die 3 and the temperature of the forging space are preferably set as follows. The temperatures of the upper die 2 and lower die 3 immediately before the start of forging are preferably approximately 800° C. or higher. In a case in which the material used for the forging material M and the forged product P is a Ni-based alloy in particular, the temperatures of the upper die 2 and lower die 3 immediately before the start of forging are preferably approximately 1020° C. or higher, more preferably approximately 1040° C. or higher, and further preferably approximately 1050° C. or higher. The temperatures of the upper die 2 and lower die 3 immediately before the start of forging are preferably in the range of approximately 900° C. to approximately 1200° C. In a case in which the material used for the forging material M and the forged product P is a Ni-based alloy in particular, a lower temperature limit of the upper die 2 and lower die 3 immediately before the start of forging is preferably approximately 1020° C., more preferably approximately 1040° C., and further preferably approximately 1050° C. The temperature of the forging space during forging is preferably in the range of approximately 800° C. to approximately 1200° C. The temperature of the forging space during forging is also preferably in the range of approximately 900° C. to approximately 1200° C. In particular, in a case in which the material used for the forging material M and the forged product P is a Ni-based alloy, the temperatures of the upper die 2 and lower die 3 during forging are preferably in the range of approximately 850° C. to approximately 1150° C. In a case in which the material used for the forging material M and the forged product P is a Ni-based alloy, the lower temperature limit of the upper die 2 and lower die 3 during forging is preferably approximately 900° C., more preferably approximately 1020° C., further preferably approximately 1040° C., and even more preferably approximately 1050° C. In particular, in a case in which the material used for the forging material M and the forged product P is a Ti-based alloy, the temperatures of the upper die 2 and lower die 3 during forging are preferably in the range of approximately 750° C. to approximately 1050° C. However, the temperatures of the upper and lower dies immediately before the start of forging, and the temperatures of the upper and lower dies and the forging space during forging are not limited to these temperatures.

As described above, in the forging apparatus 1 and the method for manufacturing the forged product P according to the present embodiment, the charging port 51*a* of the integrally formed housing body 51 is opened to the outside, with the housing body 51 surrounding most of the inside of the housing 5. Therefore, when charging the forging material M into the housing 5 from the charging port 51*a*, that is, into the forging space, the temperature of the forging space can be prevented from dropping significantly. Furthermore, the temperature of the forging space can be maintained steadily, and as a result, the temperatures of the forging material M and the upper die 2 and lower die 3 arranged in the forging space can be prevented from dropping significantly. Also, since the number of times the lowered temperatures of the upper die 2 and lower die 3 are raised again and the time required to increase the temperatures again can be reduced, fluctuations of the temperatures of the upper die 2 and lower die 3 can be suppressed. As a result, deterioration of the upper die 2 and lower die 3 can be prevented, thereby extending the replacement cycle of the upper die 2 and lower die 3. In addition, even when the upper die 2 and lower die 3 move relatively, the heating mechanism 4 is moved relatively with respect to at least one of the upper and lower dies in the die facing direction. Consequently, the conditions under which the heating mechanism 4 heats the upper die 2 and lower die 3 can be maintained constant, and the uniformity of the temperatures of the upper die 2 and lower die 3 can be maintained efficiently. As a result, the temperature of the forging space and the temperature of the forging material M can be prevented from dropping, thereby efficiently maintaining the uniformity of the temperatures of the upper die 2 and lower die 3 and improving the forging efficiency. Consequently, the forged product P having adequate quality can be manufactured efficiently.

In the forging apparatus 1 and the method for manufacturing the forged product P according to the present embodiment, the condition in which the reference position J of the heating mechanism 4 in the die facing direction and the center position K between the upper die 2 and lower die 3 in the die facing direction match each other in the die facing direction is maintained. Therefore, even when the upper die 2 and lower die 3 move relatively, the conditions under which the heating mechanism 4 heats the upper die 2 and lower die 3 can be maintained constant, efficiently maintaining the uniformity of the temperatures of the upper die 2 and lower die 3.

In the forging apparatus 1 and the method for manufacturing the forged product P according to the present embodiment, the heating mechanism 4 has the upper and lower heating portions 41 and 42, wherein the upper and lower heating portions 41 and 42 are capable of adjusting the heating temperatures of the upper and lower heating portions 41 and 42 independently of each other. Thus, since the heating temperatures of the upper and lower heating portions 41 and 42 can be adjusted independently of each other so as to suppress the variations in temperatures of the upper die 2 and lower die 3 in the die facing direction, the uniformity of the temperatures of the upper die 2 and lower die 3 can be maintained efficiently.

In the forging apparatus 1 and the method for manufacturing the forged product P according to the present embodiment, the gas supply mechanism 6 supplies the inert gas G to the inside of the housing 5. Therefore, the oxidation of the upper die 2 and lower die 3 located in the forging space can be efficiently prevented by the inert gas G supplied to the forging space so as to reduce the oxygen concentration in the inside of the housing 5, that is, the forging space. Therefore, the upper die 2 and lower die 3 can be efficiently prevented from deteriorating, and therefore, the replacement cycle of the upper die 2 and lower die 3 can be extended efficiently.

In the forging apparatus 1 and the method for manufacturing the forged product P according to the present embodiment, the gas supply mechanism 6 supplies the inert gas G to the cavity portions 22 and 23 of the upper die 2 and lower die 3 in the die closed condition in which the upper die 2 and lower die 3 are closed. Therefore, supplying the inert gas G directly to the cavity portions 22 and 23 can efficiently reduce the oxygen concentrations of the cavity portions 22 and 23 of the upper die 2 and lower die 3, and efficiently prevent oxidation of the cavity portions 22 and 23, which is particularly crucial in forging. As a result, the upper die 2 and lower die 3 can be efficiently prevented from deteriorating, and therefore, the replacement cycle of the upper die 2 and lower die 3 can be extended efficiently.

In the forging apparatus 1 and the method for manufacturing the forged product P according to the present embodiment, when the die facing direction is along the vertical direction, the housing body 51 includes the lower die passage port 51*b* that is opened to allow the lower die 3 to be inserted therethrough so as to be movable in the die facing direction, wherein the lower gap I is formed between the lower die 3 and the rim portion 51*c* of the lower die passage port 51*b*. Therefore, even in a case in which the inside of the housing 5 is filled with the inert gas G, an excess inert gas G can be released from the lower gap I. In particular, the temperatures of the upper die 2 and lower die 3 can be prevented from fluctuating easily by providing a discharge port for discharging the excess inert gas G to the outside of the housing 5 through the lower gap I, at a position away from the upper die 2 and lower die 3. As a result, the upper die 2 and lower die 3 can be efficiently prevented from deteriorating, and therefore, the replacement cycle of the upper die 2 and lower die 3 can be extended efficiently.

Although an embodiment of the present invention has been described thus far, the present invention is not limited to the foregoing embodiment, and the present invention can be modified and changed on the basis of the technical idea thereof.

REFERENCE SYMBOL LIST

1: Forging apparatus
2: Upper die, 21: Outer peripheral side surface, 22: Cavity portion
3: Lower die, 31: Outer peripheral side surface, 32: Cavity portion

4: Heating mechanism, 41: Upper heating portion, 42: Lower heating portion
5: Housing, 51: Housing body, 51*a*: Charging port, 51*b*: Lower die passage port, 51*c*: Rim portion, 52: Door
6: Gas supply mechanism
J: Reference position, K: Center position
G: Inert gas
I: Lower gap
M: Forging material, P: Forged product
S1: Gas supply step, S2: Charging step, S3: Forging step

The invention claimed is:

1. A forging apparatus comprising:
an upper die;
a lower die facing the upper die;
a heating mechanism configured to be able to heat the upper die and the lower die; and
a housing in which the upper die, the lower die, and the heating mechanism are arranged, the upper die and the lower die being configured to be movable relative to each other in a facing direction of the upper die and the lower die so as to be able to forge a forging material between the upper die and the lower die,
wherein the housing is integrally formed so as to surround the upper die, the lower die, and the heating mechanism, and comprises a housing body having a charging port opened so as to allow the forging material to pass therethrough, and a door configured to be able to open and close the charging port of the housing body, the housing body having an upper die passage port that is opened to allow the upper die to be inserted therethrough so as to be movable in the facing direction and a lower die passage port that is opened to allow the lower die to be inserted therethrough so as to be movable in the facing direction,
wherein an entirety of the housing is configured to be movable in the die facing direction,
wherein the heating mechanism is disposed so as to partially or entirely face outer peripheral side surfaces of the upper die and the lower die, and
wherein the heating mechanism is configured to move in the facing direction relatively with respect to the upper die and the lower die moving relatively.

2. The forging apparatus according to claim 1, wherein the heating mechanism is configured to move so as to maintain a condition in which a reference position of the heating mechanism in the facing direction matches a center position between the upper die and the lower die in the facing direction.

3. The forging apparatus according to claim 1, wherein the heating mechanism comprises an upper heating portion and a lower heating portion located on a lower die side with respect to the upper heating portion in the facing direction, and
wherein the upper and lower heating portions are configured to be able to adjust heating temperatures of the upper heating portion and the lower heating portion independently of each other.

4. The forging apparatus according to claim 1, further comprising a gas supply mechanism configured to be able to supply inert gas to an inside of the housing.

5. The forging apparatus according to claim 4, wherein the upper die and the lower die each comprises a cavity portion that is configured to form a space for forging the forging material in a closed condition in which the upper die and the lower die are in contact with each other, and
wherein the gas supply mechanism is configured to be able to supply the inert gas to the cavity portions of the upper and lower dies in the closed condition of the upper and lower dies.

6. The forging apparatus according to claim 4, wherein the facing direction is along a vertical direction, and
wherein a gap is formed between the lower die and a rim portion of the lower die passage port.

7. A method for manufacturing a forged product from a forging material by forging between an upper die and a lower die facing each other inside a housing, the method comprising the steps of:
charging the forging material into the housing having an integrally formed housing body through a charging port of the housing body; and
forging the forging material between the upper and lower dies by:
(i) heating the upper and lower dies with a heating mechanism under a condition in which the charging port of the housing body is closed by a door, the heating mechanism being disposed inside the housing so as to partially or entirely face outer peripheral side surfaces of the upper and lower die;
(ii) moving the upper and lower dies relatively in a facing direction of the upper and lower dies, the upper die and the lower die being inserted through an upper die passage port and a lower die passage port opened in the housing body, respectively;
(iii) moving an entirety of the housing in the die facing direction; and
(iv) moving the heating mechanism in the facing direction relatively with respect to at least one of the upper die and the lower die moving relatively.

8. The forged product manufacturing method according to claim 7, wherein in the forging step, the relatively moving of the heating mechanism is carried out so as to maintain a condition in which a reference position of the heating mechanism in the facing direction matches a center position between the upper die and the lower die in the facing direction.

9. The forged product manufacturing method according to claim 7, further comprising, prior to the charging step or the forging step, a gas supply step of supplying inert gas to an inside of the housing.

10. The forged product manufacturing method according to claim 9, wherein in the gas supply step, the inert gas is supplied to a cavity portion that is configured to form a space for forging the forging material between the upper die and the lower die in a closed condition in which the upper and lower dies are in contact with each other.

* * * * *